US005096448A

United States Patent [19]

Grey et al.

[11] Patent Number: 5,096,448

[45] Date of Patent: Mar. 17, 1992

[54] MARKER BUOY

[76] Inventors: Brian S. Grey, P.O. Box 1378-215 4th St., Walker, Minn. 56484; Greg Christian, 8125 Vincent Ave. S., Bloomington, Minn. 55421

[21] Appl. No.: 687,690

[22] Filed: Apr. 19, 1991

[51] Int. Cl.[5] ..... B63B 21/52

[52] U.S. Cl. ..... 441/11; 441/1; 441/6; 116/26

[58] Field of Search ..... 116/26, 107; 441/11, 441/6, 1, 28-30, 20; 114/267, 293

[56] References Cited

U.S. PATENT DOCUMENTS

| | | | |
|---|---|---|---|
| 1,732,170 | 10/1929 | Simmons | 441/20 |
| 3,149,352 | 9/1964 | Christiansen | 441/28 |
| 3,500,408 | 3/1970 | Daughenbaugh | 441/20 |
| 3,506,841 | 4/1970 | Majkrzak | 441/11 |
| 3,567,562 | 3/1971 | Gordon et al. | 441/30 |
| 4,482,333 | 11/1984 | Geri et al. | 441/30 |
| 4,573,933 | 3/1986 | Cameron | 441/30 |

*Primary Examiner*—Joseph F. Peters, Jr.
*Assistant Examiner*—Clifford T. Bartz

[57] ABSTRACT

A hollow, elongated tubular member, constructed of flexible resilient material, an inlet-outlet for admitting and discharging air, and including a separate, removable sleeve constructed of material as resilient, or less resilient than the buoy bladder, for its upper portion is adapted for deployment as a portable, large, and versatile marker buoy. The height above the waterline is adjustable by controlling the amount of air therein, the sleeve is removable, interchangable, and is to be printed with the insignia to designate its use. The air pressure in the buoy is used to hold the sleeve and any lightweight device inserted between the two members in position without the use of a fastening device. The method of deploying this marker buoy includes the steps of partial inflation, positioning of the sleeve, attaching ballast weight and or anchor weight, and adjusting to the desired height above the waterline by controlling the volume of air therein.

4 Claims, 1 Drawing Sheet

MARKER BUOY

BACKGROUND OF THE INVENTION

1. Field of the Invention

Figure 1:
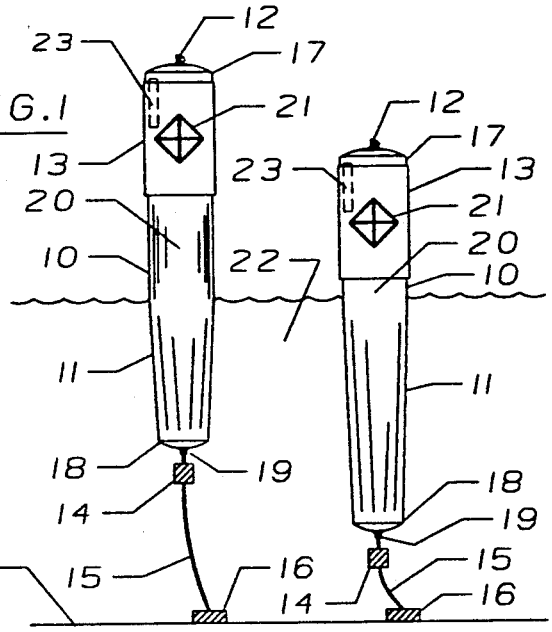

This invention relates to the use of marker buoys and is more particularly directed to an inflatable marker buoy capable of directing boat traffic to follow, or abide by certain directions as set forth by the individual buoy's printed designation, day or night.

2. Prior Art

The following is a list of prior art noted in the course of a preliminary patentability search:

| Patent No. | Issued | Title | Patentee |
|---|---|---|---|
| 2,957,446 | 10/25/60 | Dan Buoy Indicators | S. K. Zasada |
| 3,149,352 | 9/22/64 | Diver's Flag | J. S. Christianson |
| 3,605,149 | 9/20/71 | Signal Buoy | J. B. Keats |
| 3,698,025 | 10/17/72 | Marking Buoy | Worobel |

From a consideration of patents shown above, it may be seen that U.S. Pat. No. 2,957,446 shows a large, solid structure on which the flat indicator for the buoy must be mechanically fastened; U.S. Pat. No. 3,149,352 shows an inflatable buoy on which is contained the means for which to affix a flat, flag type indicator at a 90 degree angle to the vertical attitude of the buoy; U.S. Pat. No. 3,605,149 shows a solid structure possessing an internal electronic lighting system; U.S. Pat. No. 3,698,025 shows a solid structure possessing an internal electronic lighting system.

None of the preceding noted prior art, nor any of which applicants are presently aware, illustrates the novel and unobvious invention as will be set forth below.

BRIEF DESCRIPTION OF THE INVENTION

Our method and apparatus for providing an inflatable marker buoy capable of variable designations or uses, is adjustable in height above the waterline and can be used day or night is comprised of an elongated flexible and resilient structure that provides means for which a ballast weight can be applied to its lower portion, is hollow and will expand when partially filled with air in order to create sufficient buoyancy necessary to facilitate a vertical attitude above the waterline when weight of sufficient mass is applied above the waterline when weight of sufficient mass is applied to its lower portion. It also comprises a removable, interchangeable sleeve which is constucted from nylon, or other suitable material providing a lightweight, printable surface for which the printing of the desired insignia may be applied in order to designate the buoy for a specific use or purpose. The sleeve also provides the capability of holding and maintaining the position of a lightweight device between the sleeve and bladder such as a flashlight, flagmast or other device, without the need for fastening apparatus due to the air pressure in the bladder exerting an outward force against the sleeve. The sleeve may also be fitted with a pocket to hold such a device when not in use.

It is therefore an object of our invention to provide an improved marker buoy.

Another object of our invention is to provide an improved method for deployment, revovery, and storage of a marker buoy.

A still-further object of our invention is to provide an inflatable marker buoy which is adjustable in height above the waterline, highly visable, lightweight, and can easily be applied to a wide range of designations or uses by virtue of the removable, interchangeable sleeve.

It is a still further object of our invention to provide a durable, reuseable marker buoy that may be economically fabricated of readily available material.

Figure 2:
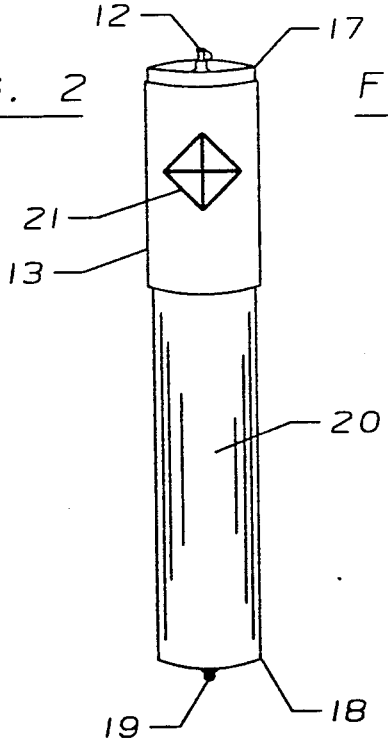
Figure 3:
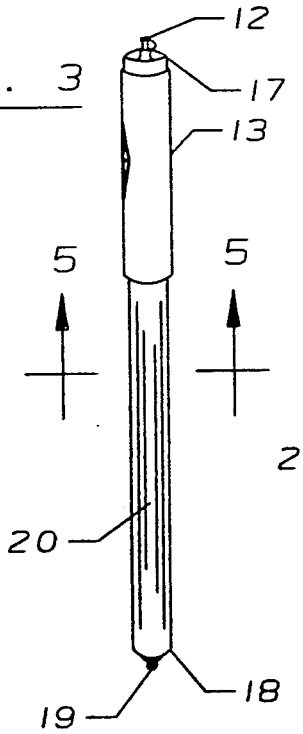
Figure 4:
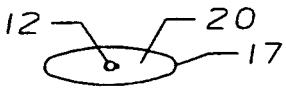
Figure 5:
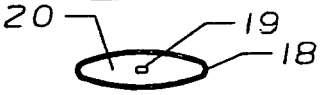
Figure 6:
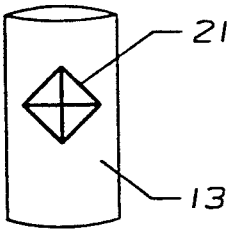
Figure 7:
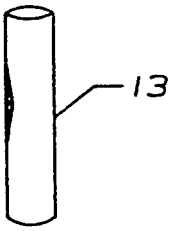

These and other objects of our invention will become apparent from a consideration of the appended specification, claims and drawings in which;

FIG. 1. is a side elevational view of a body of water illustrating a preferred embodiment of our invention in two states of operation;

FIG. 2. is an enlarged front elevational view of the preferred embodiment of FIG. 1;

FIG. 3. is a side elevational view of the apparatus of FIG. 2;

FIG. 4. is a top plan view of the apparatus of FIGS. 2 and 3;

FIG. 5. is a sectional view taken along section lines 5—5 on FIG. 3;

FIG. 6. is an enlarged front elevational view of the sleeve as the preferred embodiment of FIG. 1; and FIG. 7. is a side elevational view of FIG. 6.

Referring now to the drawings, our marker buoy is indicated generally by reference character 20. The portion of our marker buoy that is shown above the waterline is indicated by reference character 10. The portion of our buoy that is below the waterline is indicated by reference character 11. The body of water is indicated by reference character 22. The removable, interchangeable sleeve is indicated by reference character 13.

Buoy 20 is comprised of a hollow elongated tube 10 and 11 having a top 17 and bottom 18 and a valve assembly 12 for admitting and releasing air under pressure . An aperture 19 is provided on bottom 18 for receiving a line 15 that may be used for supporting a ballast weight.

Buoy 20 may be fabricated of materials exhibiting flexibility and resiliency characteristics so that tube 10 and 11 will expand beyond their normal shape when air under pressure is introduced through valve assembly 12. In one embodiment of our invention tube 10 and 11 was constructed from B-2 (cold weather flexibility) type Poly Vinyl Chloride material, was provided at a predetermined length and sealed at top and bottom ends 17 and 18 and valve assembly 12 attached to an aperture by suitable adhesive means.

Sleeve 13 may be fabricated of materials which are lightweight, printable, and exhibiting resiliency characteristics the same as, or less than buoy 20. The longitudinal length of sleeve 13 may be equal to, or less than, the maximum vertical height of tube 10. Sleeve 13 may possess a cross sectional shape slightly smaller than tube 10 when tube 10 is in the operational state. Sleeve 13 may possess a pocket for which to contain a lightweight device 23. Sleeve 13 may possess any variation of insignia 21.

Device 23 may be a flashlight, flagmast, radio transmitter, or other lightweight device as may be desired for a specific use.

Insignia 21 on sleeve 13 may be printed in any fashion, shape or color as may be required, including reflectorization.

OPERATION

Our buoy 20, is typically fabricated so that in a deflated state, the longitudinal length is sufficient to permit a proper vertical attitude, in a range from 6" to 36"

above the waterline. As shown in the left portion of FIG. 1, buoy 20 is deployed in a body of water 22 to its maximum vertical height above the waterline. As shown in the right portion of FIG. 1, buoy 20 is deployed in a body of water 22 in a lesser degree of height above the waterline. In both left and right sides of FIG. 1, tube 10 and 11 will maintain identical air pressure while the volume of interior air can vary, due to the equalizing, hydrostatic pressure of water 22 resisting the buoyancy of tube 10, with weight 14 added to the bottom of tube 11.

When sleeve 13 is in position on tube 10 and buoy 20 is in operation, the constant air pressure in tube 10 will cause sleeve 13 to maintain firm contact with tube 10, which will hold sleeve 13 in position. The firm contact between sleeve 13 and tube 10 during operation permits the insertion of device 23 between sleeve 13 and tube 10. The position of device 23 will be maintained as a result of the pressurized contact between sleeve 13 and tube 10. Also, when buoy 20 is not in operation, sleeve 13 can easily be removed, replaced with a different sleeve, or positioned as desired on tube 10.

Buoy 20 may be deployed and operated with one weight 16 by tying line 15 at such a length to weight 16 as to facilitate a vertical attitude of buoy 20 while weight 16 remains in contact with the lake bottom 24 to prevent drift.

Buoy 20 may be deployed and operated with ballast weight 14 attached to line 15 at some point between grommet 19 and anchor weight 16. Ballast weight 14 will facilitate a vertical attitude of buoy 20 and anchor weight 16 will prevent its drift.

I claim:

1. A marker buoy, comprising, in combination:

a hollow, longitudinally elongated bladder comprised of material exhibiting resiliency characteristics permitting the walls of said bladder to expand when unrestrained, said bladder including means for receiving and discharging air under pressure to and from the interior thereof and adapted to be deployed in a body of water so that the longitudinal axis will remain in a vertical attitude, with one end of said bladder being above the water when a weight of a sufficient and constant mass is applied to its bottom;

a lightweight, removable sleeve having printed matter thereon and exhibiting resiliency characteristics the same as, or less than the bladder, and of such longitudinal length as to extend over all or or part of the bladder that remains above the waterline, with a cross sectional shape is such, that during operation, a firm contact between bladder and sleeve is created whereby the position of said sleeve, and any lightweight device inserted between the sleeve and bladder, will be maintained without the use of any further fastening device.

2. The subject matter of claim 1 in which the elongated bladder is constructed of polyvinyl chloride.

3. The subject matter of claim 1 in which the sleeve is constructed of Nylon.

4. The subject matter of claims 1–3 in which the elongated bladder and sleeve are of tubular configuration.

* * * * *